US005868242A

United States Patent [19]

Hall et al.

[11] Patent Number: 5,868,242

[45] Date of Patent: Feb. 9, 1999

[54] TOGGLE SWITCH LOCKOUT DEVICE

[75] Inventors: Bradley D. Hall, Oconomowoc; Gene A. Wright, Pewaukee, both of Wis.

[73] Assignee: Brady Corporation, Milwaukee, Wis.

[21] Appl. No.: 899,258

[22] Filed: Jul. 23, 1997

[51] Int. Cl.[6] ..... H01H 9/28

[52] U.S. Cl. ..... 200/43.14; 200/43.22

[58] Field of Search ..... 200/43.11, 43.14, 200/43.15, 43.22

[56] References Cited

U.S. PATENT DOCUMENTS

| | | | |
|---|---|---|---|
| 4,020,662 | 5/1977 | Fowler | 70/237 |
| 4,758,724 | 7/1988 | Osika | 200/315 |
| 5,092,359 | 3/1992 | Wirth et al. | 137/382 |
| 5,260,528 | 11/1993 | Benda | 200/43.14 |
| 5,324,897 | 6/1994 | Melgoza et al. | 200/43.11 |
| 5,385,417 | 1/1995 | Wade et al. | 400/472 |
| 5,432,308 | 7/1995 | Howie, Jr. | 200/43.14 |
| 5,434,378 | 7/1995 | McLean | 200/537 |
| 5,558,209 | 9/1996 | Moshen | 200/43.22 |

*Primary Examiner*—Wynn Wood Coggins
*Assistant Examiner*—Michael J. Hayer
*Attorney, Agent, or Firm*—Quarles & Brady

[57] ABSTRACT

A lockout device has a baseplate which mounts to a control panel containing a toggle switch. The baseplate provides a hinged attachment for a cover that is swung down to a locked position in which the operation of the toggle switch is inhibited. In one embodiment the cover is integrally formed with the baseplate, and in a second embodiment the cover is removed when swung open from the locked position.

8 Claims, 3 Drawing Sheets

TOGGLE SWITCH LOCKOUT DEVICE

BACKGROUND OF THE INVENTION

The field of the invention is devices for locking electrical switches in one of their operating states, and particularly, the locking of electrical switches that are mounted on control panels.

There are many instances where it is desirable to lock electrically controlled equipment by disabling a switch. For example, in industrial applications safety standards may require that equipment be deenergized and locked in this state while maintenance is performed, or that certain equipment always remain operative while particular procedures are being performed. Traditionally, such switches have handles or hasps to which locks can be applied, or the switches are mounted in enclosures which can be locked.

As industrial equipment becomes more automated, manual controls have become more centralized. Whereas in the past, control switches may have been disconnects located near the equipment in lockable enclosures, industrial automation has produced centralized control panels with numerous manually operable switches and displays. In addition, industrial control systems are usually programmable and the function performed by control panel switches can be changed without rewiring them. There is a need for lockout devices which can be easily applied to control panel toggle switches in the event their operation must be securely controlled.

SUMMARY OF THE INVENTION

The present invention is a lockout device which may be applied over a toggle switch to retain it in one of its operating positions and receive a lock which secures the lockout device in place. More specifically, the lockout device includes a baseplate which fastens to the panel that supports the toggle switch, a lug formed on the baseplate, a cover which is fastened along one edge to the baseplate by a hinge, and a hasp formed on the cover. The cover may be swung from a locked position in which it substantially encloses the toggle switch and inhibits its operation and its hasp aligns with the lug on the baseplate, to an unlocked position in which the toggle switch is exposed and may be manually operated.

A general object of the invention is to provide a lockout device which may be retrofitted to a toggle switch on a control panel. The baseplate is fastened to the control panel to provide a secure lug which receives the hasp on the cover and to provide a hinged support for the cover.

A more specific object of the invention is to provide a lockout device of minimum size. A slot is formed in the cover and the toggle switch operating handle extends through the slot such that the cover surrounds the switch bushing and inhibits operation of the operating handle.

Another object of the invention is to enable the lockout device to be easily removed when not in use. The cover may be hinged to the baseplate by a jaw integrally formed on the baseplate which interlocks with a hinge pin integrally formed on the cover. When swung to the unlocked position, the cover may be removed by withdrawing the hinge pin from the grasp of the jaw.

Yet another object of the invention is to provide a lockout device which is easily fastened to the control panel. The baseplate may be fastened in place by an adhesive backing which secures it to the control panel surface, or the baseplate may contain a central opening which enables it to slide over the toggle switch bushing and be fastened in place by a nut that is tightened around the bushing.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
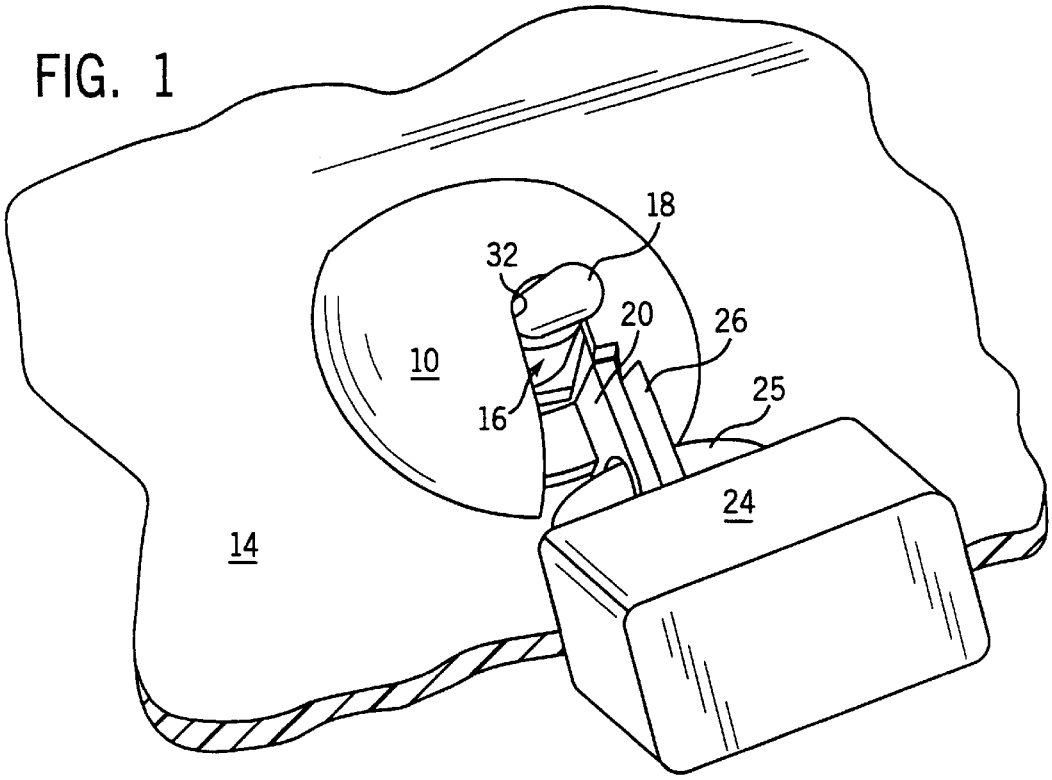
FIG. 1 is a perspective view of a first preferred embodiment of the lockout device shown in its locked configuration.

Referring particularly to FIGS. 1–4, a first preferred embodiment of the lockout device includes a dome-shaped cover 10 which is hinged to a circular baseplate 12. As will be described in more detail below, the baseplate 12 is mounted to a control panel surface 14 and surrounds a toggle switch 16 which extends through the control panel 14 and presents an operating handle 18 for manual operation. A lug 20 is integrally formed on the baseplate 12 and extends outward therefrom to define an opening 22 through which a padlock 24 may extend. A hasp 26 is integrally formed on the cover 10 and it also defines an opening 28 which aligns with the opening 22 in the lug 20 when the cover 10 is closed as shown in FIG. 1.

The cover 10 is connected to the base plate 12 by a hinge 30 formed along straight edges of both elements.

Figure 2:
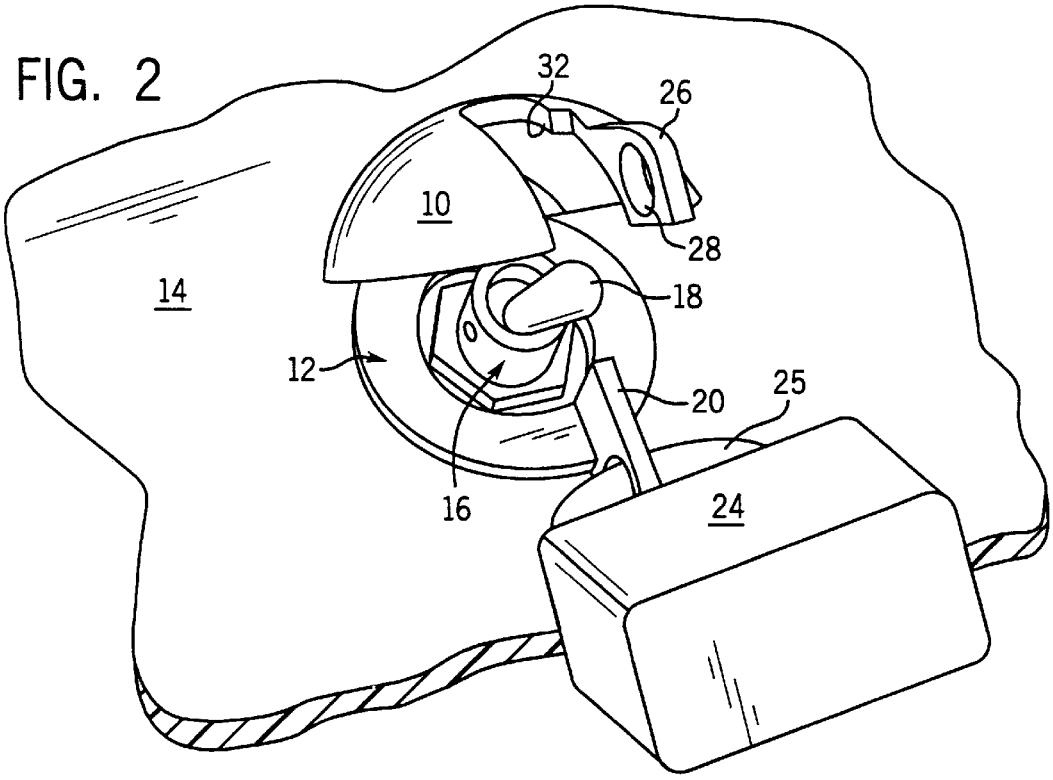
FIG. 2 is a perspective view of the lockout device of FIG. 1 shown in its unlocked configuration.
Figure 3:
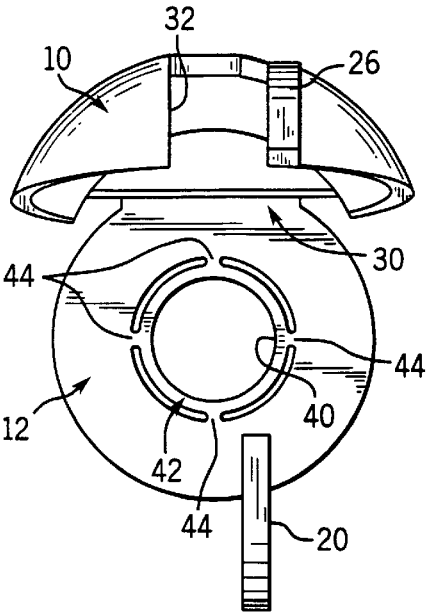
FIG. 3 is a top view of the lockout device of FIG. 1.
Figure 4:
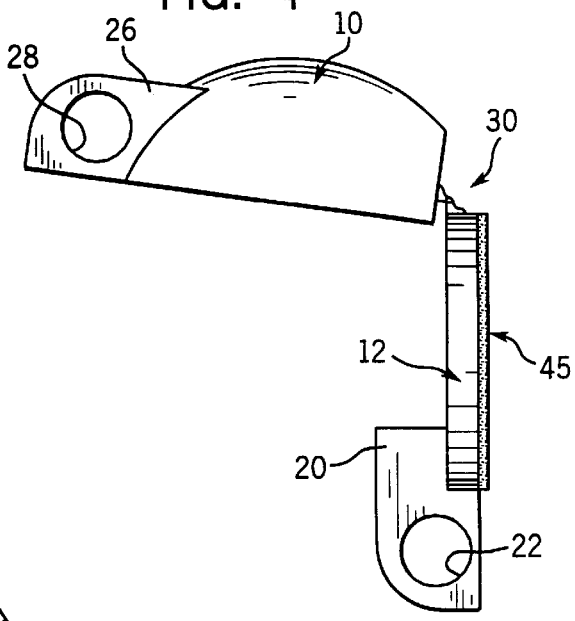
FIG. 4 is a side view of the lockout device of FIG. 1.

The cover 10 may thus be swung between an unlocked position shown in FIGS. 2–4 in which the toggle switch 16 is exposed, and a locked position shown in FIG. 1 in which the toggle switch is substantially enclosed by the cover 10. In the locked position, the openings 22 and 28 are aligned to receive a shackle 25 on the padlock 24 and the cover 10 prevents, or blocks, the operation of the toggle switch 16. A slot 32 is formed in the cover 10 to allow the switch operating handle 18 to extend therethrough and to allow the cover 10 to be swung clear to the unlocked position. This slot 32 enables the size of the lockout device to be reduced, since the operating handle 18 need not be fully enclosed. In addition, it enables the position of the switch handle 18 to 13E viewed. The shape, size and location of the slot 32 must, of course, be selected to allow the cover 10 to be swung between its locked and unlocked position, while at the same time inhibiting the operation of the toggle switch 16 when in the locked configuration.

Figure 5:
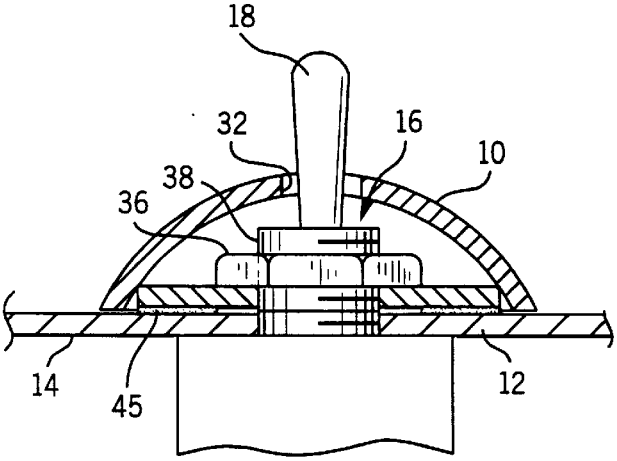
FIG. 5 is a view in cross-section through the lockout device of FIG. 1 showing one method for its attachment to a control panel.
Figure 6:
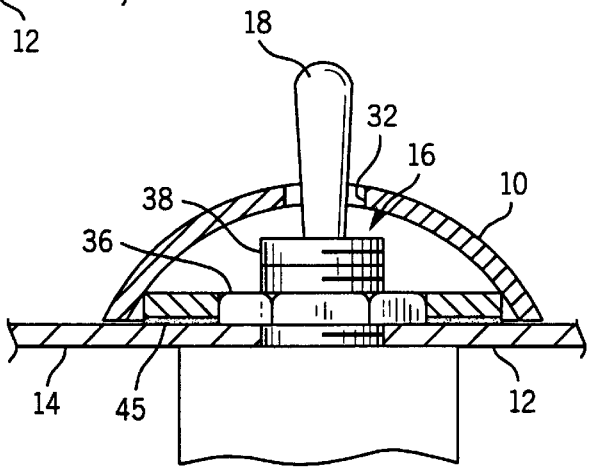
FIG. 6 is a view in cross-section through the lockout device of FIG. 1 showing a second method for its attachment to a control panel.

Referring particularly to FIGS. 3, 5 and 6, there are two methods for attaching the baseplate 12 to the control panel 14. As shown in FIG. 5, a nut 36 which engages a threaded bushing 38 on the toggle switch 16 may be temporarily removed and the switch bushing 38 received in a central opening 40 formed in the baseplate 12. The nut 36 is then placed back on the threaded bushing 38 and tightened to securely fasten the baseplate 12 to the control panel 14.

A second method for attaching the baseplate 12 to the control panel 14 is shown in FIG. 6. As shown best in FIG. 3, an annular-shaped nut plate 42 surrounds the central opening 40 in the baseplate 12, and it is integrally connected by four radially extending connecting tabs 44. The nut plate 42 may be snapped free of the baseplate 12 to form a larger opening therein which surrounds the nut 36 when the baseplate 12 is placed over the switch bushing 38. An adhesive layer 45 is provided on the bottom surface of the baseplate 12 and this fastens it to the control panel 14.

When the first mounting method is used, the toggle switch nut 36 must be removed, whereas the nut 36 remains in place when the second method is used. The adhesive layer 45 is used in both cases. As explained above, the adhesive layer 45 is the primary fastening means when the second mounting method is used, but it is also useful when the first mounting method is employed to prevent the lockout device from rotating out of position as the nut 36 is tightened. The adhesive layer 45 is comprised of a die cut foam gasket with a permanent pressure sensitive adhesive applied to both sides of the gasket. Adhesive on one side of the gasket adheres it to the bottom surface of the baseplate 12, and the adhesive on the other side of the gasket adheres it to the control panel 14. A removable liner (not shown) is placed on the exposed adhesive surface and it is removed prior to installation of the baseplate 12 around the switch 16 to be locked. An acrylic pressure sensitive adhesive is preferred since it performs best with the thermoplastic materials used to form the baseplate 12 and it performs well with materials commonly used as control panels.

The first embodiment of the lockout device is molded as a single, integral unit in one step. It is formed using an injection molded polypropylene or polyethylene thermoplastic material. This material provides the required strength and durability, as well as the flexibility needed to form the integrally molded hinge 30 that joins the baseplate 12 to the cover 10. Other thermoplastic materials may be used, but the useful life of the hinge may be shortened.

Figure 7:
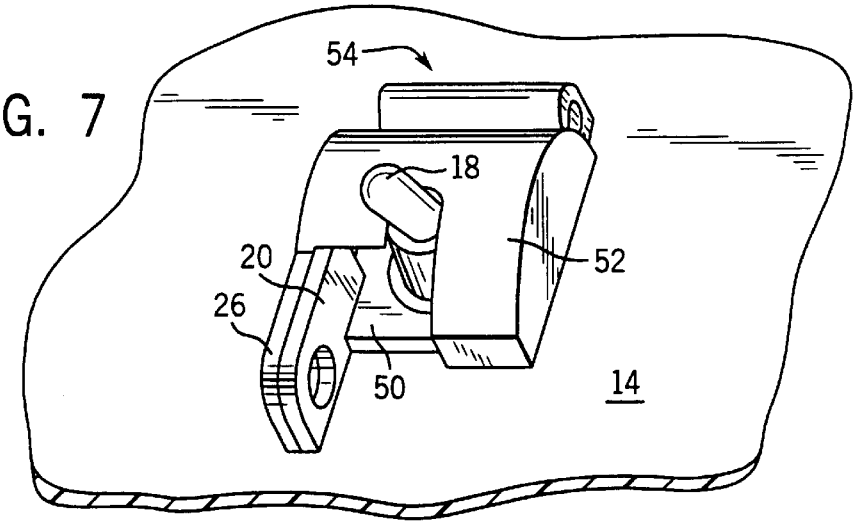
FIG. 7 is a perspective view of a second preferred embodiment of the lockout device shown in its locked configuration.
Figure 8:
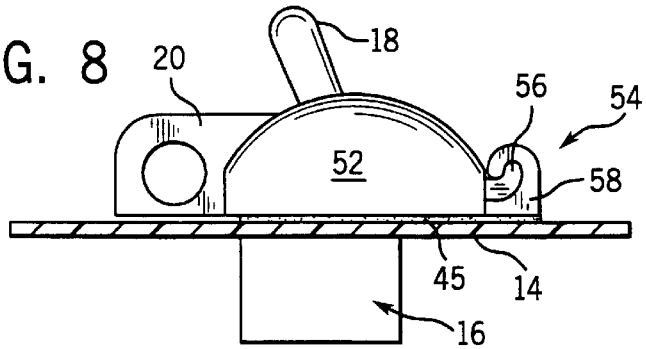
FIG. 8 is a side view of the lockout device of FIG. 7.
Figure 9:
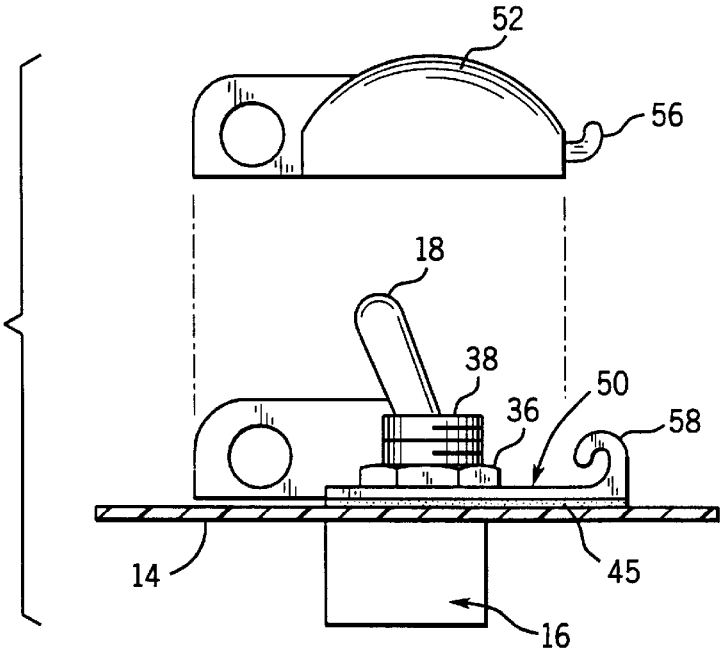
FIG. 9 is a side view of the lockout device of FIG. 7 shown in its unlocked configuration.

A second embodiment of the lockout device is shown in FIGS. 7–9. This embodiment also includes a baseplate 50 and a cover 52, but in this embodiment they have a rectangular shape. In addition, a hinge 54 is formed as two separate elements which enables the cover 52 to be completely removed from the baseplate 50 as shown in FIG. 9. More specifically, the hinge 54 is formed as a hinge pin 56 integrally molded along one edge of the cover 52, and a jaw 58 is integrally molded along one edge of the baseplate 50. When locked, the hinge pin 56 is received in the jaw 56 and securely fastened in place. When the cover 52 is swung open, however, the hinge pin 56 swings free and the cover 52 can be completely removed.

We claim:

1. A lockout device for disabling a toggle switch mounted on a control panel, the combination comprising:

a baseplate having an opening through which a bushing on the toggle switch extends and having a back surface which engages the control panel when the baseplate is fastened thereto;

means for fastening the baseplate to the control panel;

a lug formed on the baseplate and extending away therefrom to form a first opening;

a cover which is fastened along one edge to the baseplate by a hinge and which has a slot formed therein through which an operating handle on the toggle switch extends when the cover is in a locked position over the baseplate; and a hasp formed on the cover and defining a second opening which aligns with the first opening in the lug when the cover is in the locked position over the baseplate;

wherein the cover prevents the operation of the toggle switch when in its locked position.

2. The lockout device as recited in claim 1 in which the baseplate and cover are molded as an integral article.

3. The lockout device as recited in claim 1 in which the hinge is formed by a hinge pin integrally formed on the cover and a jaw integrally formed on the baseplate, and the cover is unfastened from the baseplate when swung away from its locked position.

4. The lockout device as recited in claim 1 in which the means for fastening is an adhesive layer applied to the back surface of the baseplate which engages the control panel.

5. The lockout device as recited in claim 1 in which the baseplate includes a nut plate which surrounds the central opening and is removable to define a larger opening in the baseplate which fits around a nut on the toggle switch bushing.

6. The lockout device as recited in claim 5 in which the nut plate is formed with the baseplate by integrally formed connecting tabs that may be broken to remove the nut plate therefrom.

7. The lockout device as recited in claim 4 in which an acrylic pressure sensitive adhesive is used.

8. The lockout device as recited in claim 2 in which the integral article is molded using a thermoplastic material.

* * * * *